US005927204A

United States Patent [19]

Waaijer

[11] Patent Number: 5,927,204

[45] Date of Patent: Jul. 27, 1999

[54] DEVICE FOR ROLLING UP PRINTED SHEETS

[75] Inventor: Martinus J.M. Waaijer, AP Melick, Netherlands

[73] Assignee: Oce-Technologies B.V., MA Venlo, Netherlands

[21] Appl. No.: 09/096,532

[22] Filed: Jun. 12, 1998

[30] Foreign Application Priority Data

Jun. 12, 1997 [DK] Denmark ..... 1006297

[51] Int. Cl.[6] ..... B41F 1/28

[52] U.S. Cl. ..... 101/420; 101/416.1; 156/387

[58] Field of Search ..... 101/420, 416.1, 101/419, 424.2; 271/216; 156/387, 447, 446, 184

[56] References Cited

U.S. PATENT DOCUMENTS

| | | | |
|---|---|---|---|
| 2,006,597 | 7/1935 | Miller | 101/420 |
| 2,191,704 | 2/1940 | Bennett | 15/208 |
| 3,823,947 | 7/1974 | Sasaki et al. | 15/210.1 |
| 4,294,637 | 10/1981 | Rump | 101/470 |
| 4,774,523 | 9/1988 | Beaufort et al. | 346/25 |
| 5,429,349 | 7/1995 | Supron et al. | 271/179 |
| 5,489,091 | 2/1996 | Greer et al. | 101/490 |
| 5,544,876 | 8/1996 | Ruch | 271/179 |

FOREIGN PATENT DOCUMENTS

| | | |
|---|---|---|
| 0639520 | 2/1995 | European Pat. Off. . |
| 1223398 | 8/1966 | Germany . |
| 4029673 | 4/1991 | Germany . |
| 4338146 | 6/1994 | Germany . |

*Primary Examiner*—Edgar Burr
*Assistant Examiner*—Anthony H. Nguyen
*Attorney, Agent, or Firm*—Birch, Stewart, Kolasch & Birch, LLP

[57] ABSTRACT

A device for rolling up a printed sheet while protecting the printing indicia on the sheet, which comprises a plurality of plate means which define a roll-forming space, first means defining a first transport path for transferring the printed sheet to the roll-forming space to be rolled up therein, second means defining a second transport path for transferring a cover sheet to the roll-forming space to be rolled up therein in juxtaposition to the printed sheet whereby the printed sheet is rolled up together with the cover sheet in the roll-forming space.

16 Claims, 3 Drawing Sheets

DEVICE FOR ROLLING UP PRINTED SHEETS

BACKGROUND OF THE INVENTION

The present invention relates to a device for rolling up sheets, which device is adapted to be coupled to a printing unit for printing sheets, and comprises a first transport path for conveying a printed sheet away from the printing unit, and a roll-forming space adjoining the first transport path for rolling up therein the printed sheet supplied through the first transport path.

A device of this kind is known from Netherlands Patent Application 1005209. When printed sheets are rolled up, the printed side of a turn comes into contact with the surface of the sheet of an adjoining turn. This may result in damage to the image and soiling of the sheet, for example if the image is formed by ink which is not yet dry during the rolling up of the sheet. This undesirable effect can occur particularly in the printing of sheets with ink which does not dry very rapidly, as may be the case in inkjet printing.

From DE-A 40 29 673 it is known to prevent these unwanted effects in the rolling up of a sheet by waiting sufficiently long after printing before rolling up the sheet.

In the ink-printing of sheets which are to be stacked it is also known to heat the sheets prior to stacking, heating being effected by a heating element in order to dry the ink (U.S. Pat. No. 4 774 523), or to keep the sheets in a stack separated by spacers until the ink is dry (U.S. Pat. Nos. 5 429 349 and 5 544 876).

SUMMARY OF THE INVENTION

An object of the present invention is to provide a device in which a printed receiving sheet can be rolled up directly without this leading to damage of the image and/or soiling of the receiving sheet. To this end, in a sheet roll-up device according to the present invention, a second transport path is provided which leads out into the roll-forming space and serves to feed a cover sheet into the roll-forming space for rolling up the cover sheet together with the printed sheet in the roll-forming space. The effect of this is that a sheet can be rolled up directly after printing without damage occurring to the image or sheet, such as ink coming off and scratching. Another effect is that the rolled-up sheet is protected by the cover sheet.

In a first embodiment of a device according to the present invention, the roll-forming space is situated on the same side of the first transport path as a printing section of the printing unit coupled to the device. The effect of this is that a sheet can be rolled up with its image side facing inwards so that the image is protected. If, in this first embodiment, the second transport path is situated on the same side of the first transport path as the roll-forming space, the effect achieved is that the cover sheet can be shorter than the image-carrying sheet, since the image does not require any protection on the innermost turn.

In a second embodiment of the device according to the present invention, the second transport path is situated on that side of the first transport path which is remote from the roll-forming space and beneath the first transport path and the roll-up device is operative earlier for the cover sheet fed via the second transport path rather than for the printed sheet fed via the first transport path. The effect of this is that the image on a sheet delivered by the first transport path with the image side facing upwards remains visible to the operator without the visibility being obstructed by a cover sheet which has been introduced.

BRIEF DESCRIPTION OF THE DRAWINGS

Other features and advantages of the present invention will be explained hereinafter by reference to the accompanying drawings wherein.

DETAILED DESCRIPTION OF THE INVENTION

Figure 1:
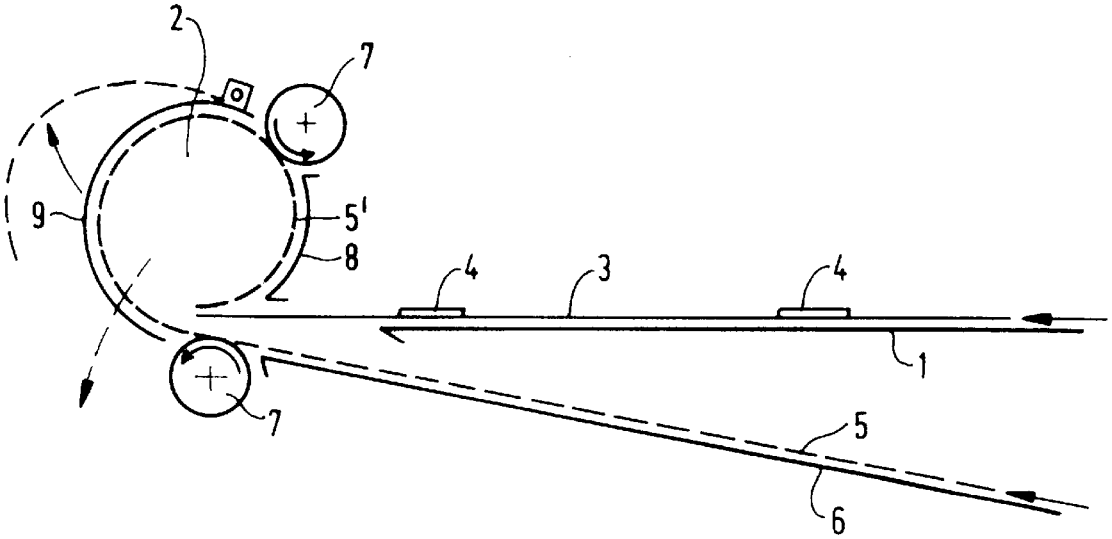
FIG. 1 diagrammatically illustrates the first embodiment of a device according to the invention.

The roll-up device diagrammatically illustrated in FIG. 1 comprises a transport path 1 for feeding a printed sheet 3 which is to be rolled up in a roll-forming space 2. Upstream of the sheet transport path 1 is a printing unit (not shown), which can provide sheets with an image 4 on the upwardly facing or top side thereof. If printing is carried out with an ink which does not dry very rapidly, the image 4 may come off when it reaches the roll-forming space 2. In order to prevent an image, which is not yet completely dry on a trailing part of a sheet which has just been printed with the image side facing inwards, from coming into contact with the back of a leading part of a sheet, a moisture-absorbing cover sheet is applied, according to the present invention, between the turns of a rolled-up printed sheet.

For this purpose, in the device shown diagrammatically in FIG. 1, a cover sheet 5 is fed via a sheet transport path 6 beneath the sheet conveyor 1 to the roll-forming space 2. The latter is formed by driven rollers 7, a fixed guide plate 8 and a swing-away guide plate 9, for example as described in Netherlands Patent Application 1005209. In order that the cover sheet 5 fed beneath the printed sheet 3 for rolling up may be brought into the roll-forming space 2 situated above the sheet transport paths 1 and 6, for the purpose of contact with the image 4, the cover sheet is fed to the roll-forming space 2 earlier than the sheet 3 for rolling. The leading part 5 of the cover sheet 5 thus forms a turn in the roll-forming space 2 before printed sheet 3 reaches the roll-forming space. This situation is shown in FIG. 1. During the rolling up of the printed sheet 3, the cover sheet 5 functions as a moisture-absorbent, blotting paper which absorbs any ink constituents which are not yet dry and thus prevents ink from coming off on to the back of the printed sheet or otherwise damaging the sheet, e.g. by causing bubbling of the sheet due to local moisture absorption. If the cover sheet 5 is of the same length as the printed sheet 3 for rolling, then the situation shown in FIG. 2 arises after the sheet 3 and cover sheet 5 have been rolled up.

In order to make rolled-up sheets less vulnerable to damage, the cover sheet can act not only as a blotting paper but also as a transport packing. For this purpose, the cover sheet is longer than the printed sheet for rolling by an amount equal to at least the peripheral length of the last turn. The outermost turn of the roll formed can thus be formed completely by the cover sheet in order to act as a protective cover for the rolled-up printed sheet.

Figure 3:
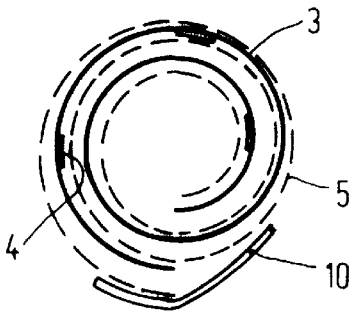
FIG. 3 shows a sheet rolled up in the device illustrated in FIG. 1, the said sheet having an adhesive strip.

As shown in FIG. 3, the roll formed is protected from unrolling by an adhesive strip 10 applied to the outermost turn. If the adhesive strip is applied to an extra wrapping turn of the top sheet, this provides the advantage that the adhesive strip does not come into contact with the printed sheet, so that the printed sheet remains undamaged even on removal of the adhesive strip. This may be important particularly for the high-quality printing of sheets such as the production of photographic posters and art reproductions.

Figure 4:
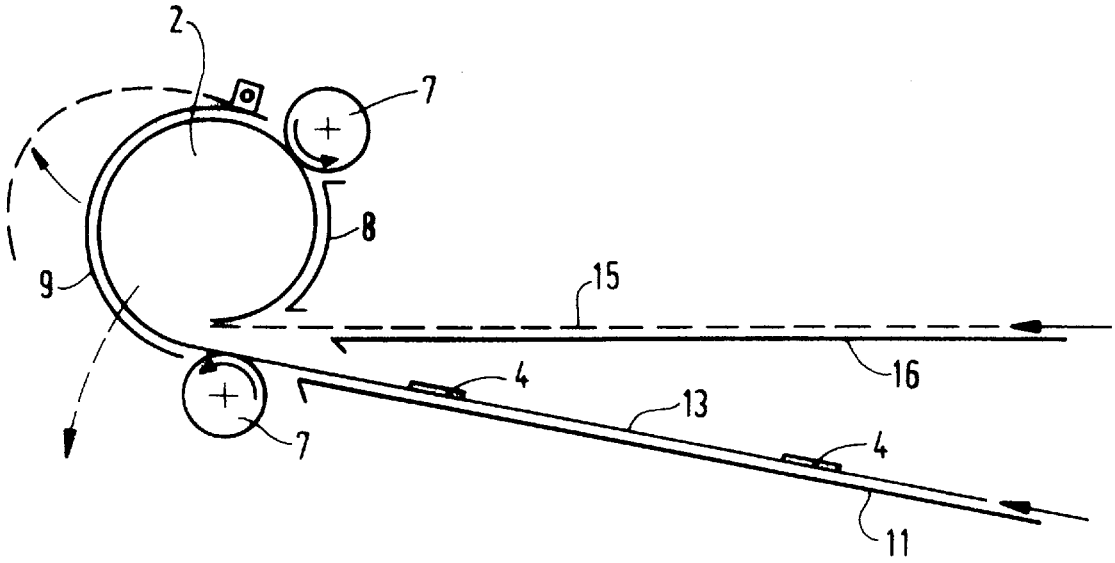
FIG. 4 diagrammatically illustrates the second embodiment of a device according to the invention.
Figure 5:
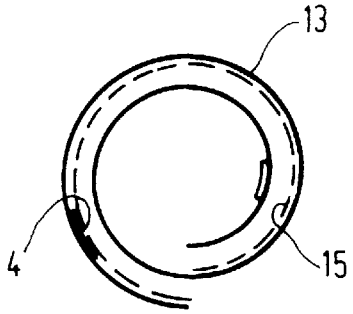
FIG. 5 shows a sheet rolled up in the device illustrated in FIG. 4, the said sheet being without an adhesive strip.
Figure 6:
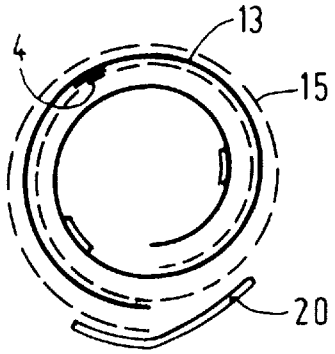
FIG. 6 shows a sheet rolled up in the device illustrated in FIG. 5, the said sheet having an adhesive strip.

In the roll-up device illustrated diagrammatically in FIG. 4, the transport path 16 for feeding the cover sheet 15 to the roll-forming space 2 is situated above the transport path 11 for feeding to the roll-forming space 2 a printed sheet 13 for rolling. As shown in FIG. 4, the cover sheet 15 does not need to be fed to the roll-forming space until after the first turn of the printed sheet has been formed. The printed side of the turn, of course, is on the inside of said turn and therefore does not need to be covered since any ink that is not yet completely dry on said innermost turn can dry in the air without coming off. Since the cover sheet 15 does not have to cover the image on the innermost turn of the printed sheet, it can be shorter than the length of the printed sheet for rolling. A roll thus formed is shown in FIG. 5. If the cover sheet 15 is also to act as a wrapping for the rolled-up printed sheet, and possibly as a support for an adhesive strip 20 to be applied thereto, then the length of the cover sheet 15 will have to be equal to the length of the printed sheet for rolling, as shown in FIG. 6. The cover sheet therefore does not have to be longer than the printed sheet, as shown in FIG. 3, in order to have the same effect. Since, in rolling the sheet into the form shown in FIGS. 3 and 6, the outermost (extra) turn does not come into contact with the image present on the sheet, the trailing part of the cover sheet 5 or 15 respectively does not have to be of liquid-absorbent material, but can also be made of a stiffer material in order to protect the rolled-up sheet from mechanical damage during further transport. A cover sheet having a strip of stiffer material is of course possible to embody easily only if the stock of cover sheets consists of pre-cut sheets whose dimensions are adapted to the dimensions of the (standard) size of printed sheet. It should be noted that the turns in FIGS. 2, 3, 5 and 6 are shown spaced apart while in actual fact the turns may lie tightly against one another.

It will be clear that a printed sheet can also be rolled up with the image side facing outwards. In that case, the outermost turn of covering material, at least on the inside of the outermost turn facing the printing, must be of a liquid-absorbent material.

Figure 7:
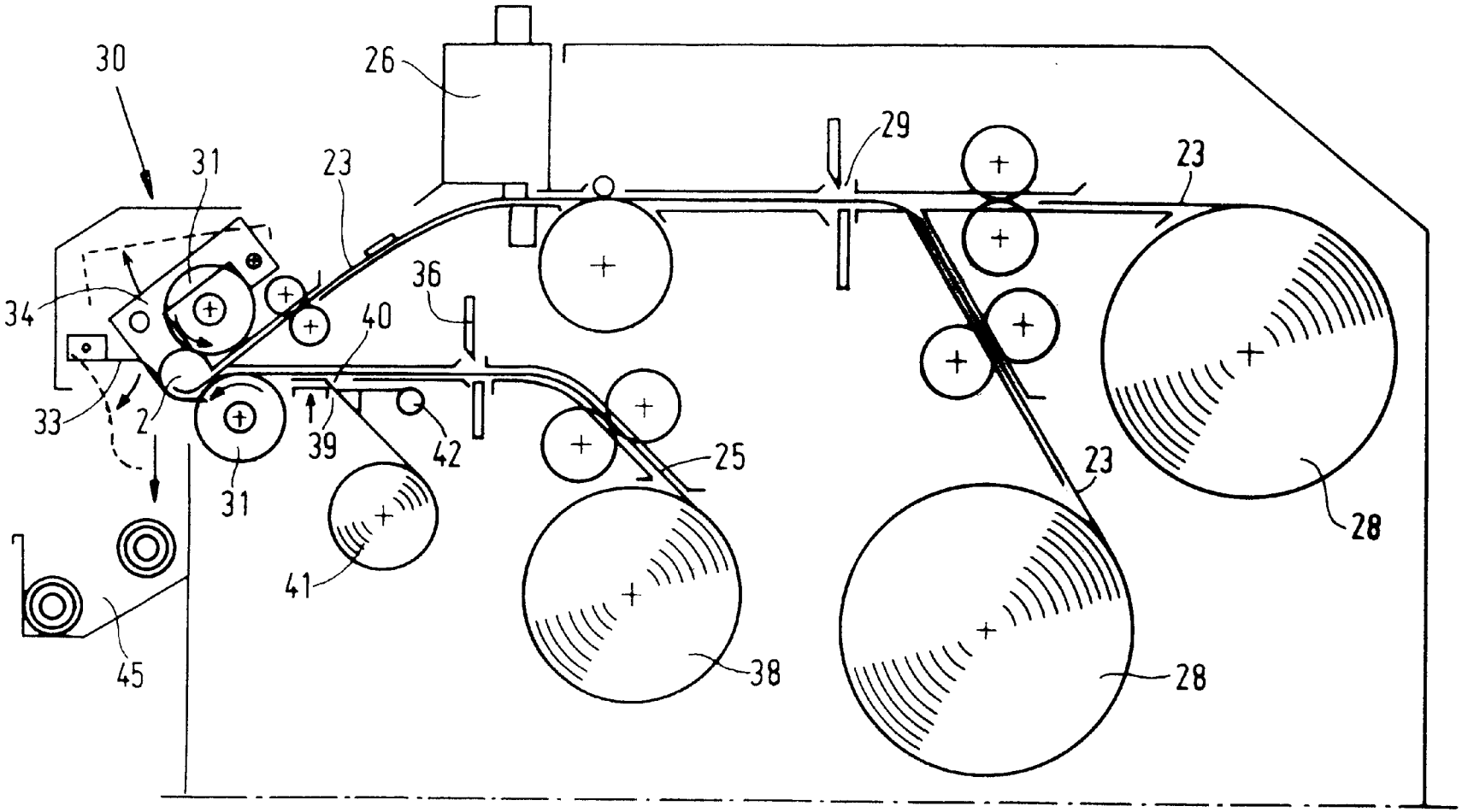
FIG. 7 shows the device of FIG. 1 in greater detail.

FIG. 7 shows one embodiment of a device for rolling printed receiving material together with a covering material 25, based on the device shown in FIG. 1.

The device shown in FIG. 7 comprises a printing unit 26 which prints receiving material 23 on its upwardly facing side. The receiving material for printing is in the form of feed rolls 28 each having a different type and/or width of receiving material. Unrolled receiving material is cut to the length of the image for printing, by means of a cutting device 29. After printing, the cut-off sheet 23 is fed to the roll-up device 30, e.g. the roll-up device described in Netherlands Patent Application 1005209, which has fixed winding rollers 31 and 31, a guide 33 adapted to swing up after the first turn has been formed, and a guide 34 which can be swung away after the rolling-up operation.

Like the receiving material, cover sheet material 25 is in the form of a feed roll 38 and is fed via a conveyor path beneath the transport path for a printed sheet 23 to the roll-up device 30 to form a turn therein before the receiving sheet 23 is fed therein, as explained previously with reference to FIGS. 1 to 3.

During the forming of the roll, swing-away guide 34 presses resiliently against the outermost turn of the roll, so that during rolling up the roll can increase in diameter. This prevents the turns from slipping along one another tangentially, which slipping can cause ink that is still wet to smear. During transport of the printed receiving sheet 23 from the printing unit 26 to the roll-up device 30, the image formed is visible for visual inspection of the printed image by an operator standing at the side of the roll-up device 30 in front of the machine.

Figure 2:
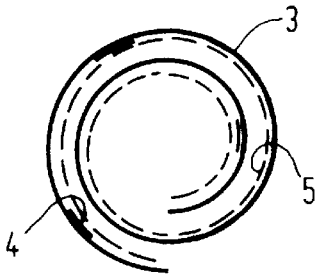
FIG. 2 shows a sheet rolled up in the device illustrated in FIG. 1, the said sheet being without an adhesive strip.

The cover material 25 is cut by a cutting device 36 to the same length as the printed sheet 23 to form the roll illustrated in FIGS. 2 and 6, of a length one turn shorter than the printed sheet 23 to form a roll illustrated in FIG. 5, or of a length one turn longer than the printed sheet 23 to form a roll as shown in FIG. 3. For further protection of the printed sheet after rolling up, it is advantageous to make the cover sheet wider than the printed sheet and then fold the projecting edges at the end of the roll into the latter. The adhesive strip 40 is fed in synchronism with the trailing edge of a cut-off cover sheet 25 and stuck by a projecting part onto said trailing edge. In the roll-forming space the projecting part then tightly closes the formed roll, for example in order to form the roll shown in FIGS. 3 and 6. The roll formed drops from the roll-up device into the receiving tray 45 by the guide 33 which swings away from the roll.

When the device shown in FIG. 7 is used for printing receiving material 23 which may have different widths, the cover material 25 should have a width corresponding to the maximum width of the material for printing. The purpose of this is to avoid the need to keep stocks of cover material of different widths. However, one possible embodiment is one in which the cover material has a fixed (narrow) width. In that case the cover material is applied between the sheet turns only in strips. If the cover material is sufficiently thick, the strips keep the turns between the strips spaced apart. In that case the cover material is provided on a minimum of two spaced-apart rollers rotatable on the same spindle and adjustable relatively to one another in order to adjust their position to the width of the receiving material for printing.

Instead of rolling up a printed sheet with the image side inwards, as is the case in the above-described embodiments, a printed sheet can also be rolled up with the image side facing out. In that case, the outermost turn should be formed by the cover sheet which has also been rolled up. If this form of rolling up is applied with the printing unit shown in FIG. 7, the roll-forming space can then be situated completely beneath the transport path for the printed sheet, and this further increases the visibility of the printed image.

When a cover sheet is applied during the rolling-up operation according to present the invention, in the case of a relatively high-speed printing unit, the sheet can be rolled up practically immediately after printing without any need to wait until the ink is dry.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for rolling up a printed sheet while protecting the printing indicia on the sheet, which comprises:

a plurality of plate means which define a roll-forming space, first means defining a first transport path for transferring the printed sheet to the roll-forming space to be rolled up therein, second means defining a second transport path for transferring a cover sheet to the roll-forming space to be rolled up therein, wherein means are provided for introducing the cover sheet and the printed sheet together to the roll-forming space and whereby the cover sheet is placed in juxtaposition to the printing indicia on the printed sheet within said roll-forming space.

2. The device of claim 1, wherein a printing unit is operatively associated with said first means which defines said first transport path.

3. The device according to claim 2, wherein the roll-forming space is situated on the same side of the first transport path as the printing unit.

4. The device according to claim 3, wherein the second transport path is situated on the same side of the first transport path as the roll-forming space.

5. The device according to claim 3, wherein the second transport path is situated beneath the first transport path.

6. The device according to claim 5, wherein the means for introducing the cover sheet from the second transport path to the roll-forming space are operated prior to operating the means for introducing the printed sheet from the first transport path, so that the cover sheet makes a substantially complete revolution within the roll-forming space before it engages the printed sheets as it is introduced into the roll-forming space.

7. The device according to claim 1, wherein the cover sheet makes a substantially complete revolution within the roll-forming space after the cover sheet is fed in juxtaposition with the printing indicia on the printed sheet, thereby forming an outermost turn made of said cover sheet.

8. The device according to claim 4, wherein the means for introducing the printed sheet from the first transport path to the roll-forming space are operable prior to operating the means for introducing the cover sheet from the second transport path so that the printed sheet makes a substantially complete revolution within the roll-forming space before it engages the cover sheet as it is introduced into the roll-forming space.

9. The device according to claim 1, wherein driving rollers, a fixed guide plate and a pivotally mounted guide plate are positioned to define the roll-forming space.

10. The device according to claim 9, wherein the pivotally mounted guide plate is adapted to swing out and away from the roll-forming space for discharge of the roll formed therein.

11. The device according to claim 1, wherein means are provided for applying an adhesive strip to the outermost sheet upon completion of the roll formation.

12. The device according to claim 9, wherein the pivotally mounted guide plate is biased against the outermost turn of the roll so that during the roll-forming process, the roll can increase in diameter without slipping.

13. The device according to claim 1, wherein cutting means are operatively associated with the first transport path and the second transport path for controlling the lengths of the printed sheet and the cover sheet.

14. The device according to claim 5, wherein a third means defining a third transport path is provided which opens out into the second transport path for feeding an adhesive strip into the second transport path at a time when the trailing edge of the cover sheet can be attached to the trailing edge to the formed roll.

15. The device according to claim 1, wherein a holder is provided for a feed roll of cover sheet material, together with a cutting device for cutting from the feed roll a cover sheet whose size corresponds to the size of a printed sheet.

16. The device of claim 1, wherein the cover sheet is a moisture-absorbent material.

* * * * *